US010035364B2

(12) United States Patent
Kotaka

(10) Patent No.: US 10,035,364 B2
(45) Date of Patent: Jul. 31, 2018

(54) PRINTING APPARATUS

(71) Applicant: SEIKO EPSON CORPORATION, Tokyo (JP)

(72) Inventor: Toshikazu Kotaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/694,091

(22) Filed: Sep. 1, 2017

(65) Prior Publication Data

US 2018/0086117 A1 Mar. 29, 2018

(30) Foreign Application Priority Data

Sep. 29, 2016 (JP) ..... 2016-190785

(51) Int. Cl.
*B65H 31/24* (2006.01)
*B41J 13/10* (2006.01)
*B41J 2/01* (2006.01)

(52) U.S. Cl.
CPC ..... *B41J 13/106* (2013.01); *B41J 2/01* (2013.01)

(58) Field of Classification Search
USPC ..... 347/104; 400/625; 271/209, 213
See application file for complete search history.

(56) References Cited

U.S. PATENT DOCUMENTS 6,027,269 A * 2/2000 Yoshida ..... B41J 13/106 271/209
6,089,772 A * 7/2000 Takemura ..... B41J 13/106 400/625
6,659,454 B1 * 12/2003 Smith ..... B41J 13/106 271/207
9,527,318 B2 * 12/2016 Chiba ..... B41J 11/0005
2015/0274477 A1 10/2015 Kodama

FOREIGN PATENT DOCUMENTS

JP 2015-189006 A 11/2015

* cited by examiner

*Primary Examiner* — Lam Nguyen

(57) ABSTRACT

A printing apparatus capable of closing a pivotable discharge portion with respect to a body.

5 Claims, 5 Drawing Sheets

PRINTING APPARATUS

BACKGROUND

1. Technical Field

The present invention relates to a printing apparatus such as, for example, an ink jet printer.

2. Related Art

Hitherto, ink jet printers are known as a type of printing apparatus that performs printing on a medium, such as a sheet of paper, by using ink that is an example of a liquid. In such printers, a printer is known that includes a discharge portion on an upper portion of an apparatus body in which the discharge portion includes a tray on which the printed medium is mounted (JP-A-2015-189006, for example). In the printer in JP-A-2015-189006, the discharge portion is provided in a pivotable manner with respect to the apparatus body so that maintenance can be carried out inside the apparatus body. In other words, the inside of the apparatus body is exposed by opening the discharge portion from the apparatus body.

Furthermore, in ink jet printers, there are cases in which the medium becomes warped due to adhesion of the liquid ejected during printing. Accordingly, the printer in JP-A-2015-189006 is provided with a projection in the middle portion of the tray to suppress such warping. Furthermore, a rack and a pinion capable of engaging with each other are provided in the discharge portion and the apparatus body to change the amount of projection in accordance with the warp amount of the medium. In other words, the projection is configured so that the amount of protrusion changes by moving the rack on the discharge portion side with the rotation of the pinion on the apparatus body side.

Incidentally, in printers configured in a manner described in JP-A-2015-189006, when opening the discharge portion from the apparatus body, there are cases in which the rack is moved out of position due to the release of the engagement between the rack and the pinion. If one tries to close the discharge portion in the above state, there are cases in which the apparatus body cannot be closed appropriately since the teeth of the rack and the teeth of the pinion interfere with each other and do not engage with each other.

SUMMARY

An advantage of some aspects of the disclosure is that the printing apparatus is capable of appropriately closing the discharge portion that is pivotable with respect to the body.

Hereinafter, an apparatus to solve the above problems and effects thereof will be described.

A printing apparatus includes a printing unit that performs printing on a medium, a body that houses the printing unit, a discharge portion to which the medium on which printing has been performed with the printing unit is discharged, the discharge portion including a mount surface on which the medium that has been discharged is mounted, the discharge portion being attached to the body so as to be pivotable between an open position in which an inside of the body is exposed and a closed position in which the inside of the body is not exposed, a detecting portion that detects the discharge portion at the closed position, a projection provided in the discharge portion, the projection protruding from the mount surface so as to be capable of supporting, from below, the medium that has been discharged, an amount of protrusion of the projection being changeable, and a control unit that controls the amount of protrusion of the projection. In the printing apparatus, the discharge portion includes a rack that is connected to the projection and that changes the amount of protrusion of the projection, the body includes a pinion capable of engaging with the rack when the discharge portion is positioned at the closed position, and a drive source that rotates the pinion, the control unit executes an initialization operation by driving the drive source to initialize the amount of protrusion of the projection when the discharge portion is pivoted from the open position to the closed position and when the detecting portion detects the discharge portion, and the detecting portion is capable of detecting the discharge portion a case in which teeth of the rack and teeth of the pinion are in contact with each other, and in a case in which the discharge portion is positioned closer to the closed position with respect to a position where the teeth of the rack and the teeth of the pinion are in contact with each other.

According to such a configuration, even in a case in which the discharge portion is pivoted from the open position to the closed position and is in the non-engaged state in which the teeth of the rack and pinion are in contact with each other but are not engaged with each other such that the discharge portion is not properly closed, since the detecting portion detects the discharge portion, the control unit executes the initialization operation that initializes the amount of protrusion of the projection. Since the execution of the initialization operation rotates the pinion, and the rack and the pinion that had been in the non-engaged state turn into the engaged state, the interference between the teeth is eliminated. Accordingly, the discharge portion pivotable with respect to the body can be closed appropriately.

In the printing apparatus described above, preferably, the detecting portion detects the discharge portion when a portion of the discharge portion comes in contact with a lever that is provided in the body and that is included in the detecting portion.

According to such a configuration, the detecting portion having a simple configuration can be manufactured.

Preferably, the printing apparatus described above further includes a lock portion capable of locking the discharge portion to the body.

With such a configuration, cases such as the discharge portion opening unintentionally due to external vibration or the like can be reduced.

Preferably, the printing apparatus described above further includes a biasing portion that biases the lock portion so that the discharge portion and the body are locked to each other.

With such a configuration, the lock portion can perform locking in a firm manner.

Preferably, in the printing apparatus described above, the lock portion includes a handgrip portion configured to cancel a state in which the discharge portion is locked to the body.

With such a configuration, the locking by the lock portion can be easily released.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a multifunction machine including an ink jet printer, which is a type of printing apparatus, will be described with reference to the drawings.

Figure 1:
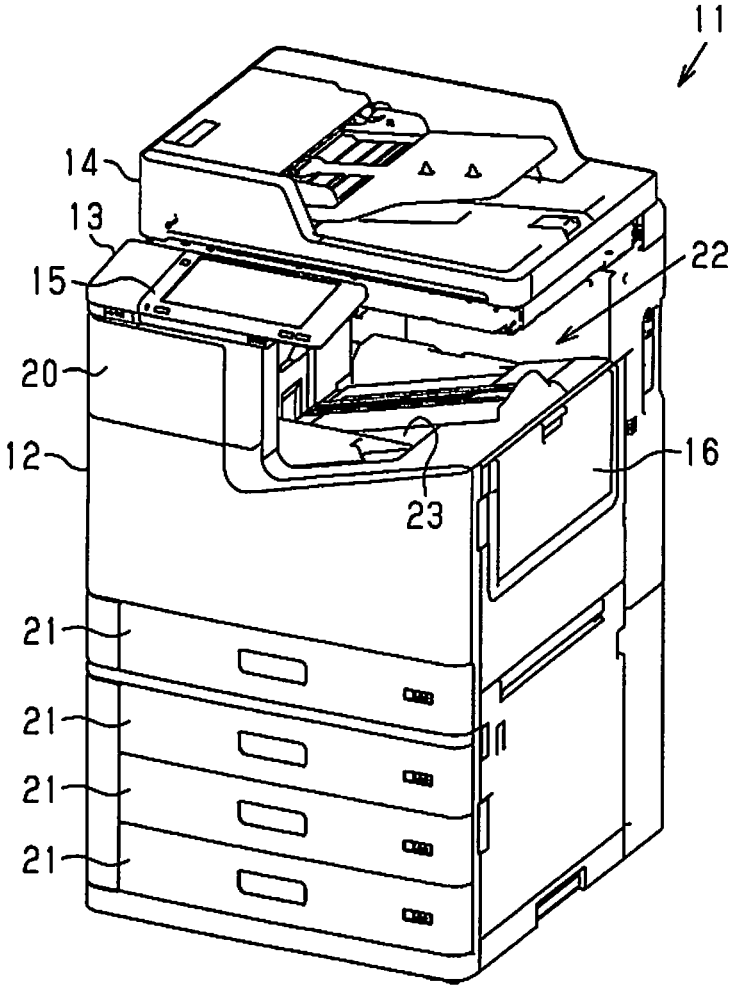
FIG. 1 is a perspective view of a multifunction machine including a printing apparatus of an embodiment.

As illustrated in FIG. 1, a multifunction machine 11 includes a printing apparatus 12 that performs printing on a medium P such as, for example, a sheet of paper, an image reading apparatus 13 that reads an image, such as text or a photograph, recorded on an original copy, and an automatic feeding apparatus 14 that feeds the original copy to the image reading apparatus 13. The multifunction machine 11 is configured such that the image reading apparatus 13 is disposed above the printing apparatus 12, and the automatic feeding apparatus 14 is disposed above the image reading apparatus 13. The apparatuses are stacked on one another in an up-down direction. The image reading apparatus 13 is provided with an operation unit 15 that is capable of integrally operating the multifunction machine 11. The operation unit 15 includes a touch panel liquid crystal display and an operation button, for example.

The printing apparatus 12 includes a body 20 that houses various members therein. A plurality of (four in the present embodiment) medium cassettes 21 capable of accommodating mediums P in a stacked state are provided in a lower portion of the body 20. A discharge portion 22 on which the medium P, on which printing has been performed inside the body 20, is disposed is provided on an upper portion of the body 20. The discharge portion 22 includes a mount surface 23 on which the medium P discharged from the body 20 is mounted.

Figure 2:
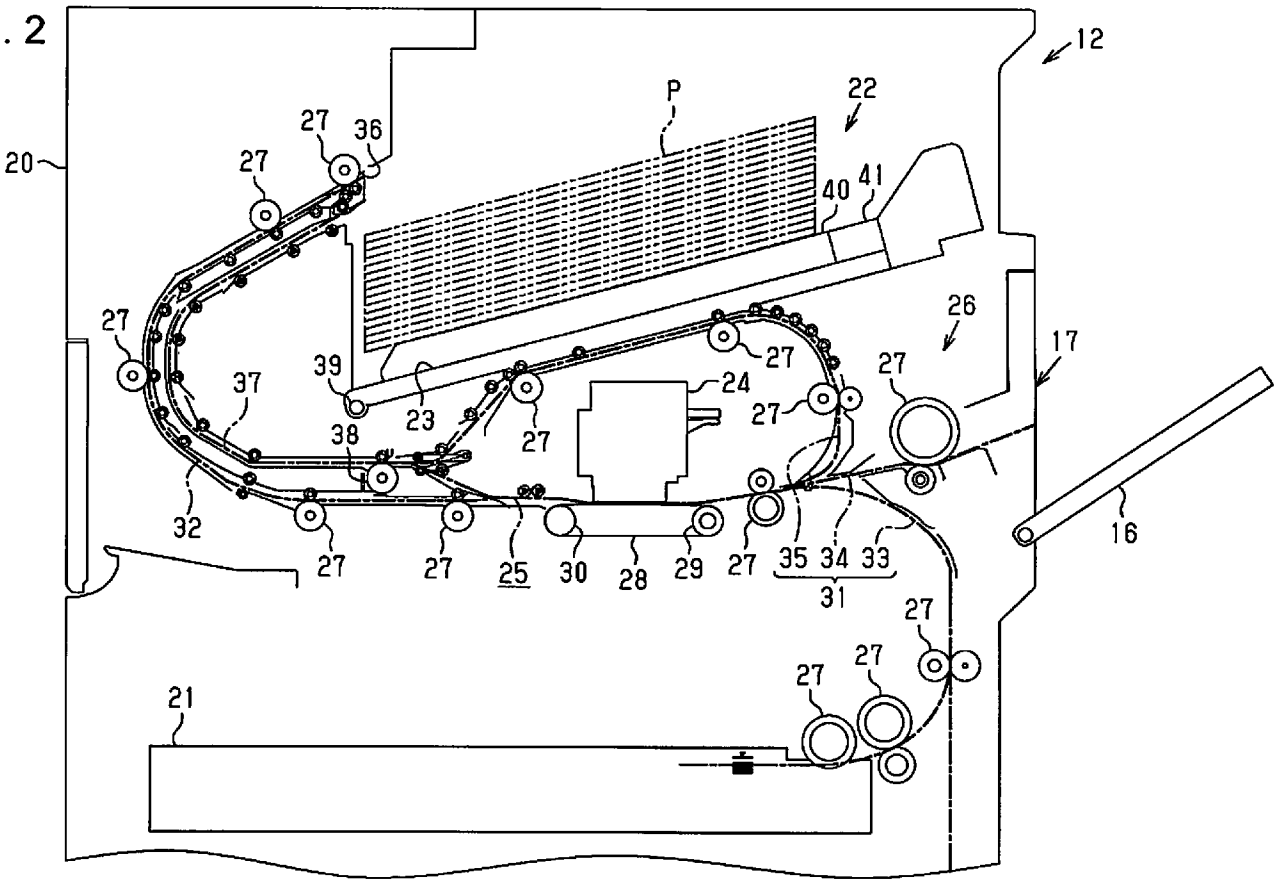
FIG. 2 is a cross-sectional view schematically illustrating an inner configuration of the printing apparatus.

As illustrated in FIG. 2, the printing apparatus 12 includes a printing unit 24 that performs printing on the medium P, and a transporting unit 26 that transports the medium P along a transport path 25. The printing unit 24 housed inside the body 20 performs printing on the medium P by ejecting a liquid such as, for example, ink, toward the medium P.

The transporting unit 26 housed in the body 20 includes a plurality of rollers 27 disposed long the transport path 25, and a transporting belt 28 disposed so as to oppose the printing unit 24. The transporting belt 28 is an endless belt stretched across a rotatable driving pulley 29 and a driven pulley 30. Furthermore, with the driving rotation of the driving pulley 29, the transporting belt 28 circulating around the driving pulley 29 and the driven pulley 30 transports the medium P.

The transport path 25 includes a feed path 31 that feeds the medium P to the printing unit 24, and a discharge path 32 that discharges the printed medium P to the discharge portion 22. The feed path 31 includes three paths, namely, a first feed path 33, a second feed path 34, and a third feed path 35.

The first feed path 33 is a path through which the mediums P accommodated in the medium cassettes 21 are transported towards the printing unit 24. The second feed path 34 is a path through which the medium P manually fed to a manual feed portion 17 exposed by opening a cover 16 attached to a lateral side (on the right side in FIG. 2) of the body 20 is transported towards the printing unit 24. The third feed path 35 is a path through which the medium P, one surface on which printing has been performed, is transported towards the printing unit 24 again so as to perform duplex printing on the medium P.

The discharge path 32 is a path that extends from the printing unit 24 towards a discharge port 36 open at an upper portion of the body 20. Furthermore, the discharge path 32 is bent so that the orientation of the transported medium P is flipped. In other words, the medium P transported through the discharge path 32 is flipped from an orientation in which the surface on which printed has been performed by the printing unit 24 faces upwards to an orientation in which the printed surface faces downwards. Furthermore, the medium P discharged from the discharge port 36 falls down towards the discharge portion 22, and the medium P is mounted so that the surface on which printing has been performed faces the mount surface 23.

Furthermore, the transport path 25 includes a branching path 37 that branches at a position midway the discharge path 32. The branching path 37 is a path that extends and is bent along the discharge path 32 and is connected to the third feed path 35 at a position midway thereof. A switch back roller 38 that is a type of roller 27 included in the transporting unit 26 and that is rotatable both in the normal direction and the reverse direction is disposed in the branching path 37. In other words, the medium P transported through the branching path 37 with the normal rotation of the switch back roller 38 is transported in a reverse manner (switched back) towards the third feed path 35 with the switch back roller 38 rotated in the reverse manner at a predetermined timing. Furthermore, the printing unit 24 performs duplex printing on the medium P transported through the third feed path 35 that extends above the printing unit 24 while the medium P that has been flipped so as to be oriented so that the surface other than the surface on which printing has been performed faces the printing unit 24 is transported.

The discharge portion 22 includes a shaft 39 on an end portion (a left end portion in FIG. 2) side that corresponds to a trailing-edge side of the discharged medium P that is opposite the leading-edge side of the medium P, and is pivotably attached to the body 20. In other words, the discharge portion 22 is pivotable about the shaft 39, which is provided at an end portion on an upper side in the discharge direction of the medium P discharged from the discharge port 36, between an open position (see FIG. 7) in which an inside of the body 20 is exposed and a closed position in which the inside of the body 20 is not exposed. Furthermore, the discharge portion 22 is provided with a holding mechanism (not shown), such as a torque hinge, capable of holding the position of the discharge portion 22 at the open position. Furthermore, the inside of the body 20 can be accessed from above by having the discharge portion 22 be open with respect to the body 20; accordingly, maintenance such as, for example, removing a jammed medium in the third feed path 35 inside the body 20, is performed. Note that when the discharge portion 22 is at the closed position, a surface thereof opposite the mount surface 23 in the up-down direction forms a portion of the third feed path 35. Furthermore, the mount surface 23 is inclined so as to extend in the discharge direction of the medium P such that the leading-edge side of the mounted medium P is higher than the trailing-edge side when the discharge portion 22 is at the closed position.

Figure 3:
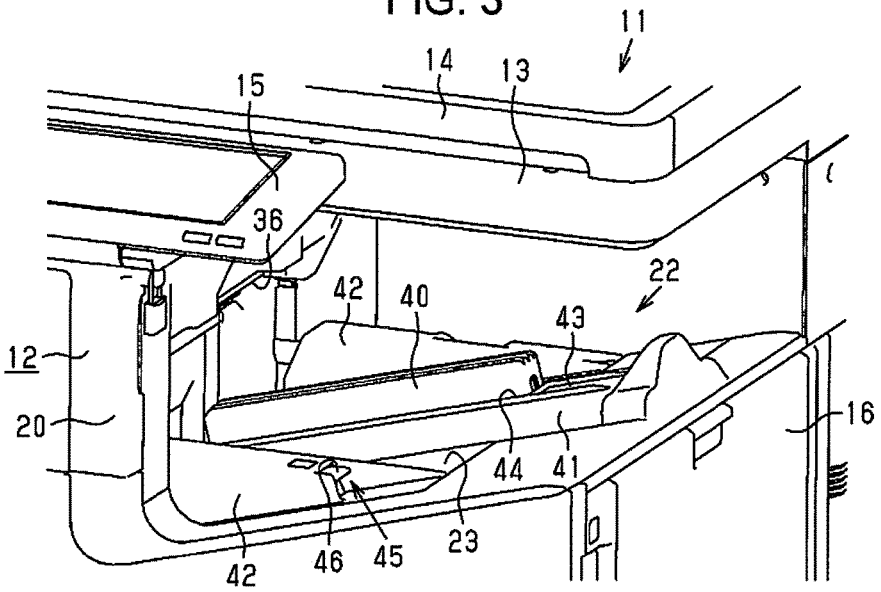
FIG. 3 is a perspective view of a discharge portion.

As illustrated in FIG. 3, the discharge portion 22 includes a projection 40 that protrudes from the mount surface 23, an accommodating portion 41 that is capable of accommodating the projection 40, and a pair of guide portions 42 that guide the medium P mounted on the mount surface 23.

The accommodating portion 41 is provided on the mount surface 23 so as to extend in the discharge direction of the medium P, and is disposed at a portion on the mount surface 23 at the middle in a width direction of the medium P that intersects the discharge direction. The accommodating portion 41 is provided so as to slightly protrude upwards from the mount surface 23, and an opening 44 that accommodates the projection 40 is formed in a top surface 43 of the accommodating portion 41. Furthermore, the projection 40 is also provided so as to extend in the discharge direction of the medium P, and is also disposed at a portion at the middle in the width direction of the medium P. The projection 40 is provided so as to protrude from the mount surface 23 through the top surface 43 of the accommodating portion 41, and is capable of supporting the middle portion of the medium P, which is mounted on the mount surface 23, in the width direction from below. Note that the projection 40 is configured so that the amount of protrusion from the accommodating portion 41 can be changed.

Note that in ink jet printers, there are cases in which the medium P is warped (curled) so as to protrude towards the printing surface on which printing has been performed when the ejected liquid adheres onto the medium P. In other words, in the present embodiment, there are cases in which the medium P mounted on the mount surface 23 becomes warped such that the two edge portions in the width direction are lifted up. Accordingly, warping of the medium P in a protruding manner is suppressed by having the projection 40 support the medium P so that the middle portion of the medium P in the width direction is lifted up.

The pair of guide portions 42 are provided so as to extend in the discharge direction of the medium P, and are disposed in the two end portions of the mount surface 23 in the width direction of the medium P. In other words, the guide portions 42 guide the medium P discharged to the discharge portion 22 by coming in contact with the edge portions of the medium P in the width direction. Furthermore, the guide portions 42 movable in the width direction are interlocked with each other, so that the distance between the guide portions 42 can be changed in accordance with the length of the discharged medium P in the width direction. Note that the guide portions 42 may be fixed to the mount surface 23.

Furthermore, a lock portion 45 capable of locking the discharge portion 22 to the body 20 is provided, among the pair of guide portions that are provided so as to be aligned in the width direction of the medium P, in the guide portion 42 positioned on the front side of the multifunction machine 11 that is a side on which the operation unit 15 is provided in the image reading apparatus 13.

The lock portion 45 is provided in a portion of the guide portions 42 downstream in the discharge direction, and includes a handgrip portion 46 that allows the user to grip thereon. In other words, by gripping and lifting up the handgrip portion 46, the lock of the lock portion 45 is released and the discharge portion 22 becomes pivotable with respect to the body 20.

Figure 4:
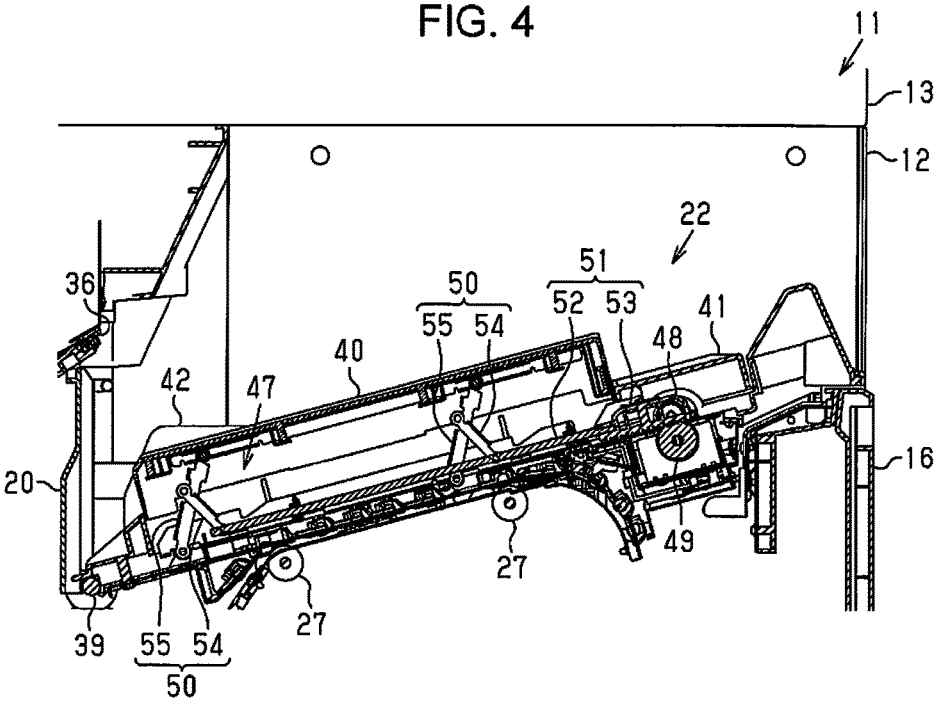
FIG. 4 is a cross-sectional view of the discharge portion in a closed position.

As illustrated in FIG. 4, a displacement mechanism 47 that changes the amount of protrusion of the projection 40 is provided in the discharge portion 22. Meanwhile, a drive source 48 driven to operate the displacement mechanism 47, and a pinion 49 rotated by the drive of the drive source 48 are provided in the body 20. The displacement mechanism 47 includes link portions 50 that lift and lower the projection 40, and a rack 51 that is connected to the link portions 50. In other words, the rack 51 is connected to the projection 40 through the link portions 50. The rack 51 includes an extending portion 52 that extends in the discharge direction of the medium P, and an engaging portion 53 that is connected to an end portion of the extending portion 52 on the downstream side in the discharge direction and that is capable of engaging with the pinion 49 provided in the body 20. Furthermore, the rack 51 is capable of moving in the direction in which the extending portion 52 extends. The link portions 50 each include a first link plate 54 and a second link plate 55 each provided with two pivotable ends, that is, a base end and a distal end. The base ends of the first link plates 54 are attached to the extending portion 52 of the rack 51, and the distal ends thereof are each attached to a portion between the base end and the distal end of the corresponding second link plate 55. The base ends of the second link plates 55 are attached to a frame portion of the discharge portion 22, and the distal ends thereof support the projection 40.

As illustrated in FIG. 4, when the rack 51 moves upstream in the discharge direction with the rotation of the pinion 49 connected to the drive source 48, the base end of the first link plate 54 is pushed upstream in the discharge direction with the movement of the rack 51, and the distal end of the first link plate 54 pushes up the second link plate 55. Furthermore, the distal end of the pushed up second link plate 55 pushes the projection 40 up and increases the amount of protrusion of the projection 40. On the other hand, in a case in which the rack 51 moves downstream in the discharge direction, the position of the distal end of the second link plate 55 is lowered; accordingly, the amount of protrusion of the projection 40 is decreased. In other words, the displacement mechanism 47 changes the amount of protrusion of the projection 40 through the interlocking between the first link plate 54 and the second link plate 55 created by the movement of the rack 51.

Figure 5:
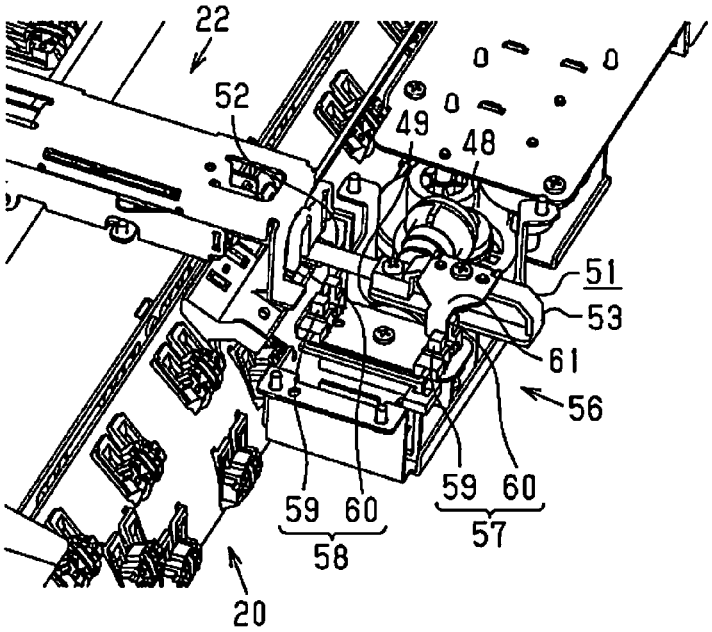
FIG. 5 is a perspective view of a rack.

As illustrated in FIG. 5, the body 20 includes a sensor unit 56 that detects the position of the rack 51 when the discharge portion 22 is in the closed position. The sensor unit 56 is provided at a position corresponding to the engaging portion 53 of the rack 51, and includes a first sensor 57 that detects the position of the rack 51 when the amount of protrusion of the projection 40 is the smallest and a second sensor 58 that detects the position of the rack 51 when the amount of protrusion of the projection 40 is the largest. The first sensor 57 and the second sensor 58 are provided so as to be aligned in the discharge direction of the medium P. The sensor position on the downstream side is the first sensor 57, and the sensor on the upstream side is the second sensor 58. Furthermore, the first sensor 57 and the second sensor 58 are each configured as a so-called photo-interrupter and each include a light-emitting portion 59 that emits light, and a light-receiving portion 60 that receives the light emitted from the light-emitting portion 59. Each light-emitting portion 59 and the corresponding light-receiving portion 60 are disposed so as to oppose each other in the width direction of the medium P. Furthermore, a plate-shaped bend portion 61 bent and extended towards the opposing light-emitting portion 59 and light-receiving portion 60 is attached to the engaging portion 53 of the rack 51. In other words, the sensor unit 56 detects the rack 51 when the light emitted from the light-emitting portion 59 towards the light-receiving portion 60 is blocked by the bend portion 61 that moves with the movement of the rack 51. Note that the sensor unit 56 is electrically connected to a control unit 62 described later, and sends a signal to the control unit 62 upon detection of the rack 51.

Figure 6:
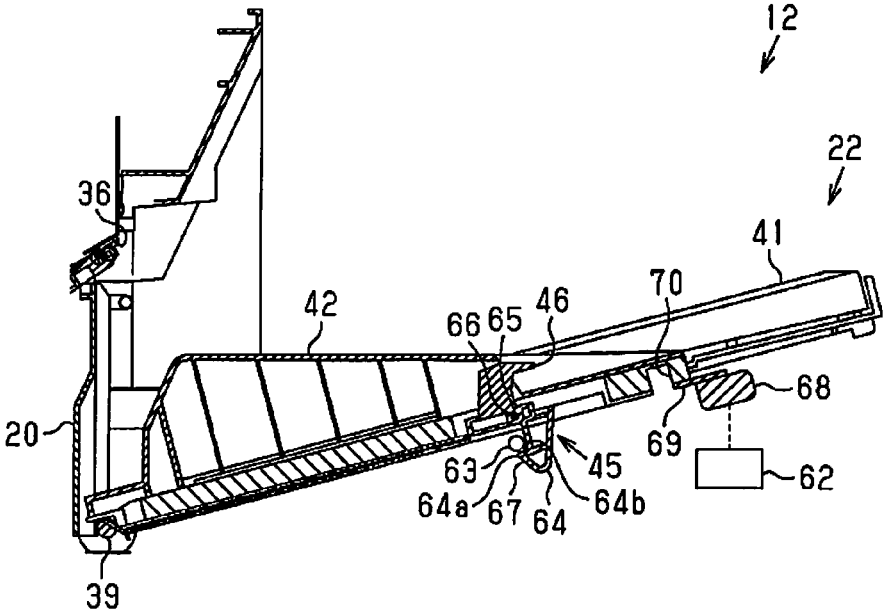
FIG. 6 is a cross-sectional view of the discharge portion in the closed position.

As illustrated in FIG. 6, the lock portion 45 included in the discharge portion 22 includes a pin 63 provided in the body 20, and a hook portion 64 that is capable of being engaged with the hook portion 64. The lock portion 45 locks the discharge portion 22 to the body 20 by having the hook portion 64 engage with the pin 63. Furthermore, the lock portion 45 includes a shaft 65 at a portion between the handgrip portion 46 and the hook portion 64, and is pivotable about the shaft 65. In other words, by having the user grip onto and lift the handgrip portion 46, the lock portion 45 is pivoted about the shaft 65, and the engagement between the hook portion 64 and the pin 63 is released. Furthermore, the shaft 65 of the lock portion 45 is provided with a spiral spring 66 serving as a biasing portion. The spiral spring 66 biases the lock portion 45 in a direction in which the hook portion 64 moves towards the pin 63 about the shaft 65. In other words, the spiral spring 66 biases the lock portion 45 in a direction that locks the discharge portion 22. Note that the hook portion 64 is provided with a slide surface 67 that slides against the pin 63 when the discharge portion 22 is pivoted from the open position to the closed position. Accordingly, when the discharge portion 22 is pivoted from the open position to the closed position, the lock portion 45 is pivoted so that the pin 63 moves over the hook portion 64 along the slide surface 67; accordingly, the hook portion 64 is engaged with the pin 63 without the handgrip portion 46 being lifted up.

The printing apparatus 12 further includes the control unit 62 that controls the amount of protrusion of the projection 40, and a detecting portion 68 that is electrically connected to the control unit 62 and that is capable of detecting the discharge portion 22. The detecting portion 68 is provided in the body 20, and is disposed so as to oppose the discharge portion 22 at the closed position. Furthermore, the detecting portion 68 includes a lever 69 for detecting the discharge portion 22. The discharge portion 22 is detected when a portion of the discharge portion 22 comes in contact with the lever 69. In other words, the detecting portion 68 detects the discharge portion 22 at the closed position when a projection 70 that protrudes downwards from the discharge portion 22 come in contact with the lever 69. Furthermore, the detecting portion 68 sends a signal towards the control unit 62 when the discharge portion 22 is detected. Note that the detecting portion 68 detects the discharge portion 22 not only when in a locked state in which the discharge portion 22 at the closed position is locked to the body 20 with the lock portion 45 but also when in a semi-locked state in which only a round surface 64*a* of the hook portion 64 and the pin 63 are in contact with each other and an engagement surface 64*b* of the hook portion 64 and the pin 63 are not engaged with each other. In the hook portion 64, the round surface 64*a* is provided adjacent to the slide surface 67, and the engagement surface 64*b* is provided adjacent to the round surface 64*a*. Furthermore, in the sensor unit 56, in order to also allow the detection of the position of the rack 51 even when the discharge portion 22 is in the semi-locked state, the bend portion 61 is provided so as to be capable of blocking the light emitted from the light-emitting portion 59 towards the light-receiving portion 60. Note that the range in which the detecting portion 68 can detect the discharge portion 22 is determined by the disposition of the lever 69 and the projection 70.

The control unit 62 is provided in the body 20, and controls the drive of the drive source 48. Note that the control unit 62 according to the present embodiment integrally controls the operation of the various members that constitute the multifunction machine 11 such as the printing operation of the printing unit 24 and the transporting operation of the transporting unit 26. Based on data such as data input from a host machine such as, for example, a computer connected to the multifunction machine 11, or data input from the operation unit 15, the control unit 62 calculates the amount of liquid ejected to the medium P and estimates the amount of warp created in the medium P. Furthermore, the control unit 62 controls the drive of the drive source 48 according to the estimated warp amount and changes the amount of protrusion of the projection 40.

Figure 7:
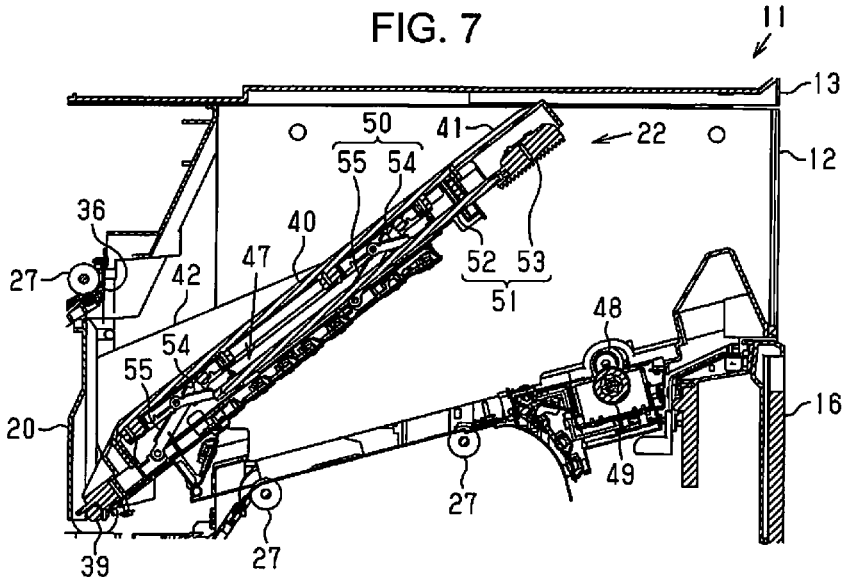
FIG. 7 is a cross-sectional view of the discharge portion in an open position.

As illustrated in FIG. 7, when the locking of the lock portion 45 is released and the discharge portion 22 is pivoted from the closed position to the open position, the engagement between the teeth of the rack 51 and the teeth of the pinion 49 is released. In the above, the projection 40 is displaced by its own weight such that the amount of protrusion thereof is reduced, and the rack 51 interlocking with the projection 40 moves downstream in the discharge direction. Furthermore, when the discharge portion 22 is pivoted from the open position to the closed position, the teeth of the rack 51 and the teeth of the pinion 49 engage with each other once more, and the discharge portion 22 is locked to the body 20 with the lock portion 45. In the above, since the projection 70 provided in the discharge portion 22 comes in contact with the lever 69 of the detecting portion 68, the detecting portion 68 detects the discharge portion 22, and a signal is sent from the detecting portion 68 towards the control unit 62. In the above, the control unit 62 receiving the signal sent from the detecting portion 68 determines that the discharge portion 22 has been displaced from the open position to the closed position, and an initialization operation that initializes the amount of protrusion of the projection 40 is executed.

The control unit 62 executing the initialization operation first controls the drive source 48 to move the rack 51 upstream in the discharge direction. Subsequently, when the second sensor 58 detects the bend portion 61 of the rack 51, the control unit 62 stops the drive source 48 and ends the initialization operation.

In other words, when the discharge portion 22 closes the body 20, the control unit 62 drives the drive source 48 so that the amount of protrusion of the projection 40 is at the largest, and initializes the amount of protrusion of the projection 40.

Effects of the printing apparatus configured in the above manner will be described next.

Figure 8:
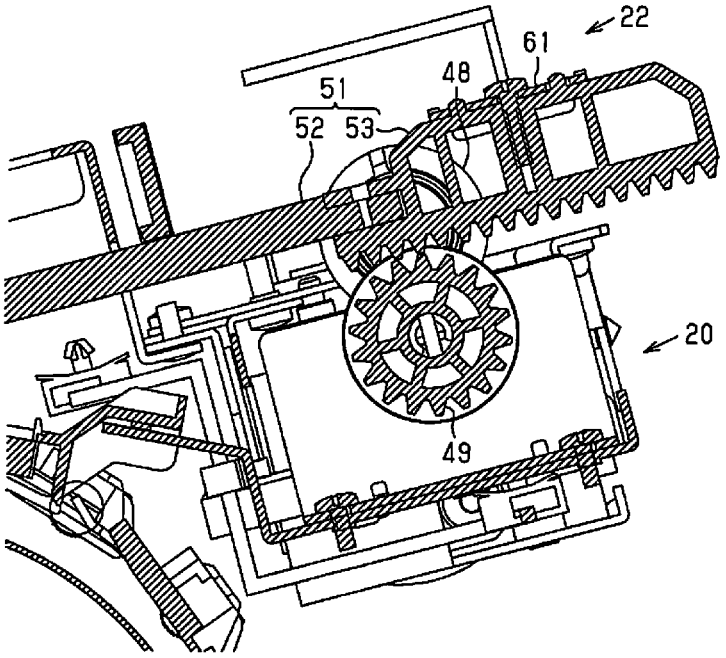
FIG. 8 is a cross-sectional view of the rack and a pinion when the teeth thereof come in contact with each other.

As illustrated in FIG. 8, when the discharge portion 22 is pivoted from the open position to the closed position, there are cases in which the rack 51 and the pinion 49 are, rather than in an engaged state in which the teeth thereof are engaged with each other, in a non-engaged state in which the teeth thereof are in contact with each other but are not engaged with each other. In a case in which the rack 51 and the pinion 49 are in the non-engaged state, the discharge portion 22 is positioned slightly above the proper closed position by the lengths of the teeth interfering with each other such that the discharge portion 22 cannot be closed in a proper manner with respect to the body 20; accordingly, the locking with the lock portion 45 is in the semi-locked state. In the above, the detecting portion 68 of the present embodiment is capable of detecting the discharge portion 22 even when the discharge portion 22 is in the semi-locked state; accordingly, the discharge portion 22 is detected even when the rack 51 and the pinion 49 are in the non-engaged state. In other words, in the detecting portion 68 according to the present embodiment, even when the teeth of the rack 51 and pinion 49 are not engaged with each other, the discharge portion 22 can be detected as long as the teeth are in contact with each other. Furthermore, the sensor unit 56 of the present embodiment is capable of detecting the position of the rack 51 even when the discharge portion 22 is in the semi-locked state; accordingly, the rack 51 is detected even when the rack 51 and the pinion 49 are in the non-engaged state. In other words, when the detecting portion 68 detects the discharge portion 22 in which the rack 51 and the pinion 49 are in the non-engaged state, the control unit 62 executes the initialization operation that initializes the amount of protrusion of the projection 40.

When the control unit 62 executes the initialization operation, the pinion 49 is rotated by the drive of the drive source 48, and the rack 51 and the pinion 49 change to the engaged state from non-engaged state. When the interference between the teeth of the rack 51 and pinion 49 is eliminated with the initialization operation, the discharge portion 22 drops to the proper closed position with its own weight and closes the body 20 in an appropriate manner, and the discharge portion 22 is locked to the body 20 with the lock portion 45.

The following effects can be obtained with the embodiment described above.

(1) Even in a case in which the discharge portion 22 is pivoted from the open position to the closed position and is in the non-engaged state in which the teeth of the rack 51 and pinion 49 are in contact with each other but are not engaged with each other such that the discharge portion 22 is not properly closed, since the detecting portion 68 detects the discharge portion 22, the control unit 62 executes the initialization operation that initializes the amount of protrusion of the projection 40. Since the execution of the initialization operation rotates the pinion 49, and the rack 51 and the pinion 49 that had been in the non-engaged state turn into the engaged state, the interference between the teeth is eliminated. Accordingly, the discharge portion 22 pivotable with respect to the body 20 can be closed appropriately.

(2) The detecting portion 68 detects the discharge portion 22 when the lever 69 comes in contact with the projection 70 included in the discharge portion 22. Accordingly, the detecting portion 68 having a simple configuration can be manufactured.

(3) Since the lock portion 45 that can lock the discharge portion 22 to the body 20 is provided, cases such as the discharge portion 22 opening unintentionally due to external vibration or the like can be reduced.

(4) Since the spiral spring 66 that biases the lock portion 45 in the direction locking the discharge portion 22 and the body 20 to each other is provided, the lock portion 45 can perform locking in a firm manner.

(5) Since the lock portion 45 includes the handgrip portion 46 that cancels the state in which the discharge portion 22 is locked to the body 20, the locking by the lock portion 45 can be easily released by merely gripping and lifting the handgrip portion 46.

(6) Since the initialization operation that initializes the amount of protrusion of the projection 40 also includes the operation of changing the state of the rack 51 and the pinion 49 from the non-engaged state to the engaged state, the control operation with the control unit 62 can be facilitated.

Note that the embodiment described above may be modified as follows. Furthermore, the following examples of modification can be combined as appropriate.

The biasing portion may include, for example, a coil spring, or an elastically deforming rubber.

Similar to the sensor unit 56, the detecting portion 68 that detects the discharge portion 22 may be, for example, a photo-interrupter. Furthermore, the detecting portion 68 may perform detection using an ultrasonic wave or an electromagnetic wave.

The sensor unit 56 that detects the rack 51 may include, for example, a linear encoder.

The lock portion 45 may be provided in each of the pair of guide portions 42.

Not limited to a unit that ejects liquid, the printing unit 24 may include a unit that ejects solid matter such as toner. The warp (curl) created in the medium P printed with the printing unit 24 may be created also by, for example, heat treatment preformed to dry the medium P.

Not limited to a sheet of paper, the medium P may be a piece of fabric, a plastic film, or the like.

The printing apparatus 12 may be a fluid ejection apparatus that performs printing by ejecting or discharging a fluid (a liquid, a liquid body formed of a functional material dispersed or mixed in a liquid, a fluid body such as gel, and a solid that can be made to flow and ejected as a fluid) other than ink. For example, the printing apparatus may be a liquid body ejection apparatus that performs recording by ejecting a liquid body that includes, in a dispersed or dissolved manner, a material such as an electrode material or a color material (a pixel material) that is used to manufacture liquid crystal displays, electroluminescence (EL) displays, and surface emitting displays. Furthermore, the printing apparatus may be a fluid body ejection apparatus that ejects a fluid body such as gel (physical gel, for example), or a particulate matter ejection apparatus (toner jet recording apparatus, for example) that ejects solid such as, for example, powder (particulate matter) including toner. Furthermore, the invention can be applied to either one of the fluid ejection apparatuses described above. Note that in the present specification, a "fluid" is a concept that does not include a fluid that is only formed of gas, and a fluid includes, for example, a liquid (an inorganic solvent, an organic solvent, a solution, a liquid resin, a liquid metal (a metallic melt), and the like), a liquid body, a fluid body, and a particulate matter (for example, grain or powder).

The entire disclosure of Japanese Patent Application No.: 2016-190785, filed Sep. 29, 2016 is expressly incorporated by reference herein.

What is claimed is:

1. A printing apparatus comprising:

a printing unit that performs printing on a medium;

a body that houses the printing unit;

a discharge portion to which the medium on which printing has been performed with the printing unit is discharged, the discharge portion including a mount surface on which the medium that has been discharged is mounted, the discharge portion being attached to the body so as to be pivotable between an open position in which an inside of the body is exposed and a closed position in which the inside of the body is not exposed;

a detecting portion that detects the discharge portion at the closed position;

a projection provided in the discharge portion, the projection protruding from the mount surface so as to be capable of supporting, from below, the medium that has been discharged, an amount of protrusion of the projection being changeable; and a control unit that controls the amount of protrusion of the projection, wherein the discharge portion includes a rack that is connected to the projection and that changes the amount of protrusion of the projection, wherein the body includes a pinion capable of engaging with the rack when the discharge portion is positioned at the closed position, and a drive source that rotates the pinion, wherein the control unit executes an initialization operation by driving the drive source to initialize the amount of protrusion of the projection when the discharge portion is pivoted from the open position to the closed position and when the detecting portion detects the discharge portion, and wherein the detecting portion is capable of detecting the discharge portion in a case in which teeth of the rack and teeth of the pinion are in contact with each other, and in a case in which the discharge portion is positioned closer to the closed position with respect to a position where the teeth of the rack and the teeth of the pinion are in contact with each other.

2. The printing apparatus according to claim 1, wherein the detecting portion detects the discharge portion when a portion of the discharge portion comes in contact with a lever that is provided in the body and that is included in the detecting portion.

3. The printing apparatus according to claim 1, further comprising a lock portion capable of locking the discharge portion to the body.

4. The printing apparatus according to claim 3, further comprising a biasing portion that biases the lock portion so that the discharge portion and the body are locked to each other.

5. The printing apparatus according to claim 3, wherein the lock portion includes a handgrip portion configured to cancel a state in which the discharge portion is locked to the body.

* * * * *